US009040795B2

(12) United States Patent
Yoshino

(10) Patent No.: US 9,040,795 B2
(45) Date of Patent: May 26, 2015

(54) CYMBAL

(71) Applicant: ROLAND CORPORATION, Shizuoka (JP)

(72) Inventor: Kiyoshi Yoshino, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 92 days.

(21) Appl. No.: 13/958,632

(22) Filed: Aug. 5, 2013

(65) Prior Publication Data

US 2014/0116227 A1 May 1, 2014

(30) Foreign Application Priority Data

Oct. 31, 2012 (JP) ..... 2012-239894

(51) Int. Cl.
*G10D 13/08* (2006.01)
*G10D 13/06* (2006.01)

(52) U.S. Cl.
CPC ..... *G10D 13/06* (2013.01); *Y10T 29/49574* (2015.01)

(58) Field of Classification Search
USPC ..... 84/402
See application file for complete search history.

(56) References Cited

U.S. PATENT DOCUMENTS

| | | | | |
|---|---|---|---|---|
| 5,965,834 | A | 10/1999 | Suenaga et al. | |
| 6,310,277 | B1 | 10/2001 | Shelley | |
| 7,915,507 | B2 * | 3/2011 | Onheiser | 84/421 |
| 2008/0105104 | A1 | 5/2008 | Stannard | |

FOREIGN PATENT DOCUMENTS

| | | |
|---|---|---|
| JP | H08-272359 | 10/1996 |
| JP | H11-184459 | 7/1999 |
| JP | H11-272266 | 10/1999 |

* cited by examiner

*Primary Examiner* — Jianchun Qin
(74) *Attorney, Agent, or Firm* — Jianq Chyun IP Office

(57) ABSTRACT

A cymbal is provided with an annular part having an annular shape and having a predetermined rigidity, a center part located at an inner circumference of the annular part and having a predetermined rigidity, and a first connecting part including an elastic material and connecting an outer circumference of the center part and the inner circumference of the annular part.

17 Claims, 3 Drawing Sheets

CYMBAL

CROSS-REFERENCE TO RELATED APPLICATION

This application claims the priority benefit of Japan application serial no. 2012-239894, filed on Oct. 31, 2012. The entirety of the above-mentioned patent application is hereby incorporated by reference herein and made a part of this specification.

BACKGROUND OF THE INVENTION

1. Field of the Invention

The present invention relates to a cymbal. Particularly, the present invention relates to a cymbal which can reduce a percussive sound while preventing a decline of the percussing sense of the cymbal.

2. Description of the Related Art

Metal acoustic cymbals have high rigidity and can generate a loud percussive sound. Accordingly, a technology to reduce a percussive sound of the acoustic cymbal has been developed. In the technology disclosed in Patent Document 1, a cymbal silencer including a stretchable material (material with high performance for reducing a vibration), such as rubber, is attached to an upper surface or an edge of the acoustic cymbal. Then, a part that the cymbal silencer is attached to is struck during a performance. As a result, a percussive sound of the acoustic cymbal can be reduced.

However, in the technology described in the above-mentioned Patent Document 1, the percussion sound is reduced by striking the part that the cymbal silencer is attached to. Therefore, there was a problem that an original percussing sense obtained by striking a metal acoustic cymbal with high rigidity declined.

PRIOR ART REFERENCE

Patent Document

Patent Document 1: JP Patent Publication No. H08-272359 Gazette (paragraphs [0005] and [0006], etc.)

SUMMARY OF THE INVENTION

The present invention has been made in order to solve the above-mentioned problem. An object of the present invention is to provide a cymbal which can reduce a percussion sound while preventing a percussing sense from declining.

According to one aspect of the present invention, an annular part and a center part of the cymbal have a predetermined rigidity. Therefore, by directly striking the annular part and the center part, a player can have the percussing sense similar to that of striking the metal acoustic cymbal.

In addition, the annular part and the center part are connected by a first connecting part including an elastic material. Therefore, when striking one of the annular part and the center part, transportation of vibration from one of the annular part and the center part to the other one can be suppressed. Moreover, the vibration of the annular part and the center part can be reduced by the first connecting part.

Accordingly, a percussion sound of the annular part or the center part can be reduced while preventing a percussing sense obtained by striking the metal acoustic cymbal with high rigidity from declining.

According to the other aspect of the present invention, the cymbal has the following additional effect. The cymbal includes a slit, which extends from an inner circumference of the annular part to an outer circumference of the annular part and divides the annular part. Therefore, when the annular part is struck, transmission of vibration along a circumferential direction of the annular part can be blocked.

Moreover, two ends of the annular part, which face each other with the slit therebetween, are connected by a second connecting part including an elastic material. Therefore, the vibration of the annular part can be reduced by the second connecting part. Accordingly, a percussion sound of the annular part can be easily reduced.

According to a further aspect of the present invention, the cymbal has the following additional effect. The slit is formed along a radial direction of the annular part. Therefore, the length of the slit in the radial direction of the annular part can be shortened. Accordingly, a reduction of the rigidity of the annular part due to the formation of the slit can be suppressed.

In addition, by shortening the length of the slit in the radial direction of the annular part, the second connecting part can be easily prevented from being struck when a performer tries to strike the annular part during playing.

According to a further aspect of the present invention, the cymbal has the following additional effect. The first connecting part includes a joint part which connects an inner circumference of the annular part and an outer circumference of the center part, and a reinforcing part which is formed along the joint part and across a lower surface of the annular part and a lower surface of the center part. Therefore, the annular part and the center part can be connected firmly.

The joint part connects the inner circumference of the annular part and the outer circumference of the center part, and the reinforcing part is formed across the lower surface of the annular part and the lower surface of the center part. Therefore, an exposure of the first connecting part on an upper surface of the annular part and on an upper surface of the center part can be reduced during playing. Accordingly, the first connecting part can be easily prevented from being struck when a performer tries to strike the annular part or the center part during playing.

Moreover, the reinforcing part is formed in a belt shape and is attached to the lower surfaces of the annular part and the lower surface of the center part along the joint part. Therefore, comparing with a case in which a vibration damping member, such as a rubber, is attached to the entire lower surfaces of the annular part and the center part, a weight increase of the entire cymbal can be suppressed. Accordingly, a percussing sense of striking the cymbal can be prevented from declining.

According to a further aspect of the present invention, the cymbal has the following additional effect. The center part is formed in a cup shape sloping downward toward the outer circumference of the center part in a radial direction, and the annular part is formed in an annular shape sloping downward toward the outer circumference of the annular part at an angle less steep than that of the center part. Therefore, the shape of the cymbal can be similar to that of the acoustic cymbal.

In other words, the acoustic cymbal includes a bell portion and a bow portion. The bell portion is formed in a cup shape sloping downward toward an outer circumference of the bell portion in a radial direction. The bow portion is extended in a flange shape from an outer edge of the bell portion and is formed in an annular shape sloping downward toward an outer circumference of the bow portion at an angle less steep than that of the bell portion. Accordingly, by forming the center part in a cup shape sloping downward toward the outer circumference of the center part in the radial direction of the center part, a shape of the center part can be formed similar to that of the bell portion of the acoustic cymbal. Similarly, by forming the annular part in an annular shape sloping downward toward the outer circumference of the annular part at an angle less steep than that of the center part in the radial direction of the annular part, a shape of the annular part can be similar to that of the bow portion of the acoustic cymbal.

Therefore, by connecting the center part and the annular part via the first connecting part, it is possible to make an entire shape of the cymbal similar to that of the acoustic cymbal. As a result, the center part and the annular part can be struck in a manner similar to that of striking the bell portion and the bow portion of the acoustic cymbal. Accordingly, a player can have a percussing sense similar to that of striking the acoustic cymbal.

According to a further aspect of the present invention, the cymbal has the following additional effect. A sensor, which detects the vibration of the annular part or the center part, is included. Accordingly, the cymbal of the present invention can be used as an electronic cymbal.

DESCRIPTION OF EMBODIMENTS

Figure 1B:
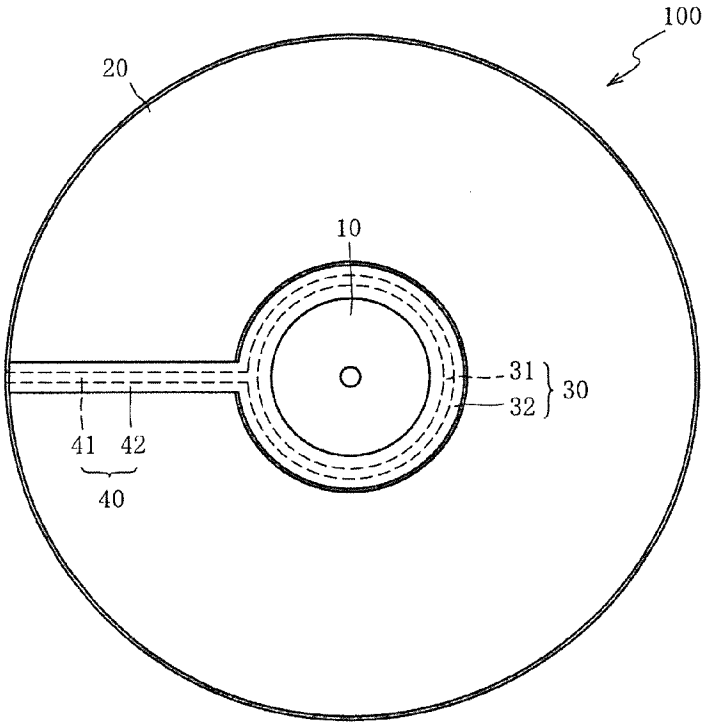
FIG. 1B is a bottom view of the cymbal according to the first embodiment of the present invention.
Figure 1A:
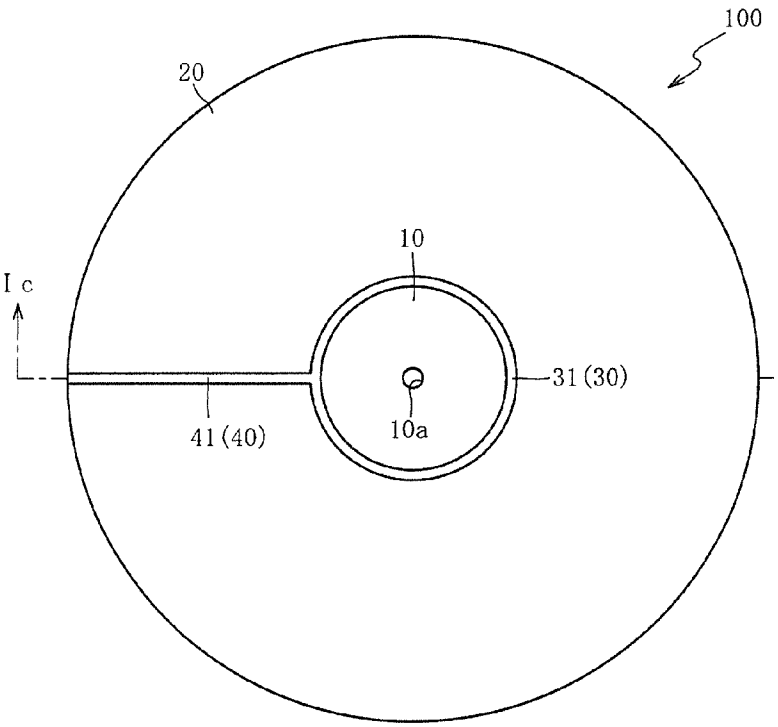
FIG. 1A is a top view of a cymbal according to a first embodiment of the present invention.
Figure 1C:
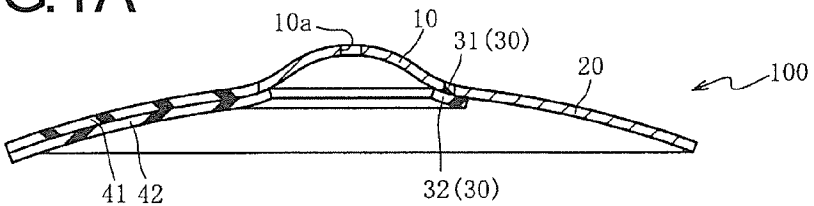
FIG. 1C is a cross-sectional view of the cymbal on the line Ic-Ic in FIG. 1A.

Preferred embodiments of the present invention are described below referring to the accompanying drawings. First, referring to FIG. 1, a cymbal 100 in a first embodiment of the present invention is described. FIG. 1A is a top view of the cymbal 100 according to the first embodiment of the present invention. FIG. 1B is a bottom view of the cymbal 100 according to the first embodiment of the present invention. FIG. 1C is a cross-sectional view of the cymbal 100 on the line Ic-Ic in FIG. 1A. FIG. 1A-FIG. 1C schematically illustrates the cymbal 100, and a first joint part 31 and a second joint part 41 are shown in a dashed line in FIG. 1B.

As shown in FIG. 1, the cymbal 100 is a training percussion which is mainly made of metal. The cymbal 100 is configured to mainly include a center part 10, an annular part 20, a first connecting part 30 and a second connecting part 40. The center part 10 is disposed in the center of the cymbal 100. The annular part 20 is located on an outer circumference of the center part 10. The first connecting part 30 is installed between the center part 10 and the annular part 20. The second connecting part 40 is extended from the first connecting part 30 toward an outer circumference of the annular part 20 in a radial direction of the annular part 20.

In addition to metal, the material of the cymbal 100, for example, can be resin materials with high rigidity, such as PP (polypropylene), PA (polyamide) and FRP (fiber reinforced plastics).

Referring to FIG. 2, configurations of the center part 10 and the annular part 20 are described. FIG. 2A is a top view of the center part 10. FIG. 2B is a cross-sectional view of the center part 10 on the line IIb-IIb in FIG. 2A. FIG. 2C is a top view of the annular part 20. FIG. 2D is a cross-sectional view of the annular part 20 on the line IId-IId in FIG. 2C.

Figure 2A:
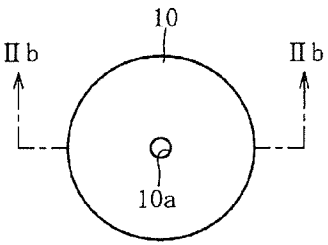
FIG. 2A is a top view of a center part of the cymbal according to the first embodiment of the present invention.
Figure 2B:
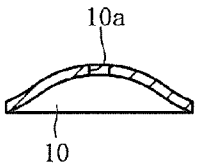
FIG. 2B is a cross-sectional view of the center part on the line IIb-IIb in FIG. 2A.

As shown in FIG. 2A and FIG. 2B, the center part 10 is a part which is formed in a substantially circular shape in top view and is formed in a cup shape sloping downward toward the outer circumference of the center part 10 in the radial direction of the center part 10. Moreover, the center part 10 includes a metal material. In the center part 10, an insertion hole 10*a*, through which a bar-shaped rod (not shown) is inserted, is drilled at the center of the center part 10 in top view. When the cymbal 100 is fixed to a drum stand (not shown), the rod connected to the drum stand is inserted into the insertion hole 10*a*. Moreover, the cymbal 100 is tightened and fixed to the rod by a nut (not shown).

Figure 2C:
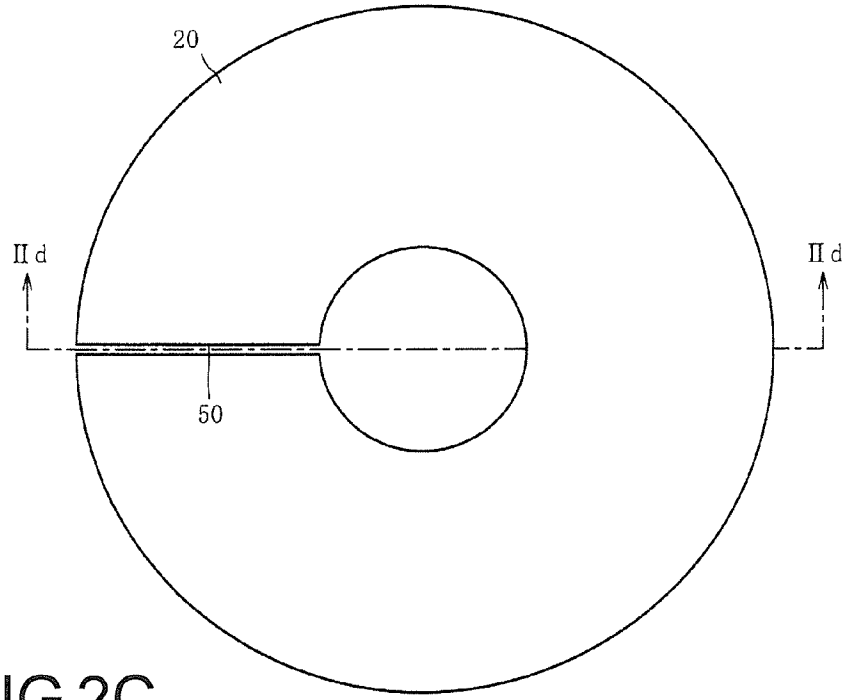
FIG. 2C is a top view of an annular part of the cymbal according to the first embodiment of the present invention.
Figure 2D:
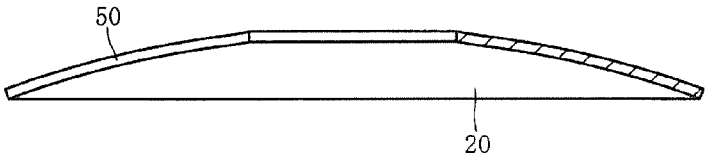
FIG. 2D is a cross-sectional view of the annular part on the line IId-IId in FIG. 2C.

As shown in FIG. 2C and FIG. 2D, the annular part 20 is an annular-shaped part sloping downward toward an outer circumference of the annular part 20 in a radial direction of the annular part 20. The slope of the annular part 20 in the radial direction of the annular part 20 is less steep than that of the center part 10. A slit 50 shaped in a substantially straight line is cut along the radial direction of the annular part 20. A circumference of the annular part 20 is divided by the slit 50.

Referring to FIG. 1, the first connecting part 30 is a part that connects the outer circumference of the center part 10 and an inner circumference of the annular part 20. The first connecting part 30 includes a rubber material. Moreover, the first connecting part 30 has a substantially T-shaped cross-section along an axis direction of the annular part (up-down direction in FIG. 1C). The first connecting part 30 includes a first joint part 31 and a first reinforcing part 32. The first joint part 31 joins an entire outer circumference of the center part 10 and an entire inner circumference of the annular part 20. The first reinforcing part 32 is formed along the first joint part 31.

In addition to rubber, the material of the first connecting part 30, for example, can be resin materials with high elasticity, such as TPE (thermoplastic elastomer) of TPU (urethane system), PVC (vinyl chloride system), SBC (styrene system) and TPO (olefinic system), and PVC (polyvinyl chloride).

The first joint part 31 is formed in a substantially annular shape viewed from the axial direction of the annular part 20. An upper surface of the first joint part 31 (upper surface in FIG. 1C) is coplanar with upper surfaces (upper surface in FIG. 1C) of the center part 10 and the annular part 20. That is, the upper surface of the center part 10 and the upper surface of the annular part 20 are smoothly connected to each other via the first joint part 31.

The first reinforcing part 32 is a belt-shaped part formed in a substantially annular shape viewed from the axial direction of the annular part 20. Moreover, a width (length along the radial direction of the annular part 20) of the first reinforcing part 32 is set to be larger than that of the first joint part 31. The first reinforcing part 32 is attached to the center part 10 and the annular part 20 in a manner that the first reinforcing part 32 is across the lower surfaces of the center part 10 and the annular part 20.

The slit 50 (see FIG. 2C) divides the circumference of the annular part 20 and forms two ends of the annular part 20, wherein the two ends face each other. The second connecting part 40 is a part that connects the two ends. The second connecting part 40 includes a rubber material. The second connecting part 40 has a substantially T-shaped cross-section along the axis direction (up-down direction in FIG. 1C) of the annular part 20. The second connecting part 40 includes a second joint part 41 and a second reinforcing part 42. The second joint part 41 connects the two ends of the annular part 20, wherein the two ends face each other. The second reinforcing part 42 is formed along the second joint part 41.

The second joint part 41 is formed in a substantially straight line along the radial direction of the annular part 20. An upper surface of the second joint part 41 (upper surface in FIG. 1C) is coplanar with the upper surfaces (upper surface in FIG. 1C) of the annular part 20. That is, the upper surface of the annular part 20 is smoothly connected via the second joint part 41.

The second reinforcing part 42 is a belt-shaped part formed in a substantially straight line along the radial direction of the annular part 20. Moreover, a width (length along a direction vertical to the radial direction of the annular part 20) of the second reinforcing part 42 is set to be larger than that of the second joint part 41. The second reinforcing part 42 is attached to the lower surface of the annular part 20 in a manner that the second reinforcing part 42 is across the two ends of the annular part 20 with the slit 50 therebetween (see FIG. 2C).

In the embodiment, the width of the first joint part 31 and the width of the second joint part 41 are set to 3 mm.

The acoustic cymbal includes a bell portion and a bow portion. The bell portion is a cup-shaped part sloping downward toward an outer circumference of the bell portion in a radial direction of the bell portion. The bow portion is an annular-shaped part extended in a flange shape from an outer edge of the bell portion and sloping downward toward an outer circumference of the bow portion in a radial direction of the bow portion and at an angle less steep than the bell portion.

In contrast, the center part 10 of the cymbal 100 is formed in a cup shape sloping downward toward the outer circumference of the center part 10 in the radial direction of the center part 10. Hereby, a shape of the center part 10 can be formed in a shape similar to that of the bell portion of the acoustic cymbal. Similarly, the annular part 20 of the cymbal 100 is formed in an annular shape sloping downward in the radial direction and at an angle less steep than that of the center part 10. Hereby, a shape of the annular part 20 can be similar to that of the bow portion of the acoustic cymbal.

Therefore, by connecting the center part 10 and the annular part 20 via the first connecting part 30, an entire shape of the cymbal 100 can be similar to that of the acoustic cymbal. As a result, the center part and the annular part can be struck in a manner similar to that of striking the bell portion and the bow portion of the acoustic cymbal. Accordingly, a player can have a percussing sense similar to that of striking the acoustic cymbal.

In addition, the center part 10 and the annular part 20 include a metal material. Therefore, by directly striking the center part 10 and the annular part 20, a player can have a percussing sense similar to that of striking the acoustic cymbal.

The center part 10 and the annular part 20 of the cymbal 100 are configured as separate elements. Therefore, direct transmission of vibration from one of the center part 10 and the annular part 20 to the other one can be blocked. In addition, the outer circumference of the center part 10 and the inner circumference of the annular part 20 are connected by the first connecting part 30, which includes an elastic material. Therefore, when striking one of the center part 10 and the annular part 20, transmission of vibration from one of the center part 10 and the annular part 20 to the other one can be suppressed. Moreover, the vibration of the center part 10 and the annular part 20 can be reduced by the first connecting part 30.

In addition, the circumference of the annular part 20 is divided by the slit 50 (see FIG. 2C). Therefore, when the annular part 20 is struck, direct transmission of vibration in the circumference of the annular part 20 can be blocked. Moreover, the two ends of the annular part 20, which face each other with the slit 50 therebetween, are connected by the second connecting part 40, which includes an elastic material. Therefore, the vibration of the annular part 20 can be reduced by the second connecting part 40.

When fixing the cymbal 100 to the drum stand (not shown), the cymbal 100 is tightened and fixed in a state of allowing the rod (not shown) connected to the drum stand to be inserted into the insertion hole 10*a* of the center part 10. Therefore, comparing with the center part 10, it is easy for the annular part 20 located on the outer circumference of the center part 10 to vibrate greatly and the percussion sound is also louder.

In contrast, because the cymbal 100 includes the second connecting part 40, the amplitude of vibration of the annular part 20 can be reduced in the early stage. Therefore, the percussion sound of the annular part 20 can be efficiently reduced.

In addition, the first connecting part 30 and the second connecting part 40 are positioned coplanar with the upper surfaces of the first joint part 31 and the second joint part 41 and the upper surfaces of the center part 10 and the annular part 20. Therefore, the first joint part 31 and the second joint part 41 can be prevented from protruding from the upper surfaces of the center part 10 and the annular part 20. Hereby, when a player plays the cymbal 100, the first joint part 31 and the second joint part 41 can be easily prevented from being struck.

In the embodiment, the widths of the first joint part 31 and the second joint part 41 are set to 3 mm; however, the widths of the first joint part 31 and the second joint part 41 may be set to different widths. Besides, the widths of the first joint part 31 and the second joint part 41 may be different. That is, a width of one part of the first joint part 41 or the second joint part 42 and a width of the other part of the first joint part 31 or the second joint part 41 may be set to different widths.

The widths of the first joint part 31 and the second joint part 41 are preferably set within a range greater than or equal to 1 mm and less than or equal to 10 mm.

By setting the widths of the first joint part 31 and the second joint part 41 to be greater than or equal to 1 mm, the vibration produced by striking the center part 10 and the annular part 20 can be reduced by the first joint part 31 and the second joint part 41.

Meanwhile, by setting the widths of the first joint part 31 and the second joint part 41 to be less than or equal to 10 mm, a reduction of the rigidity of the cymbal 100 can be suppressed, and the shape of the cymbal 100 can be maintained.

Moreover, by setting the widths of the first joint part 31 and the second joint part 41 to be less than or equal to 10 mm, in the top view of the cymbal 100, the area percentage occupied by the first joint part 31 and the second joint part 41 relative to the entire cymbal 100 can be reduced. As a result, when a player plays the cymbal 100, the first joint part 31 and the second joint part 41 can be easily prevented from being struck.

In addition, the slit 50 (see FIG. 2C) is formed in a substantially straight line along the radial direction of the annular part 20. Moreover, the two ends of the annular part 20 formed by the slit 50 are connected to each other by the second connecting part 40. Therefore, the area percentage occupied by the second connecting part 40 relative to the entire cymbal 100 can be reduced. Hereby, a reduction of the rigidity of the annular part 20 can be suppressed and a shape of the annular part 20 can be maintained. Moreover, the second joint part 41 can be easily prevented from being struck when a performer tries to strike the annular part 20.

The first reinforcing part 32 of the first connecting part 30 crosses over the center part 10 and the annular part 20. Therefore, the center part 10 and the annular part 20 can be connected firmly. In addition, the second reinforcing part 42 of the second connecting part 40 is positioned at the lower surface (lower surface in FIG. 1C) of the annular part 20 and crosses over the both ends of the annular part 20. Therefore, the both ends of the annular part 20 can be connected firmly to each other. Accordingly, a rigidity of the cymbal 100 can be ensured and a shape thereof can be maintained.

Moreover, the first reinforcing part 32 and the second reinforcing part 42 are attached to the lower surface of the center part 10 and the annular part 20. Therefore, the first reinforcing part 32 and the second reinforcing part 42 can reduce an exposure of the first connecting part 30 and the second connecting part 40 on the upper surface of the cymbal 100 during a strike by a player. Accordingly, the first connecting part 30 or the second connecting part 40 can be easily prevented from being struck when the center part 10 or the annular part 20 is struck during playing.

In addition, the first reinforcing part 32 and the second reinforcing part 42 are formed in a belt shape and are attached on the lower surface of the center part 10 or the annular part 20 along the first joint part 31 or the second joint part 41. Therefore, comparing with a case in which a vibration damping member, such as a rubber, is attached on the entire lower surface of the center part 10 and the annular part 20, a weight increase of the entire cymbal 100 can be suppressed.

That is, if a weight of the cymbal 100 becomes heavier than the acoustic cymbal, a response when striking the cymbal 100 becomes stronger so that a swing of the cymbal 100 with respect to the rod becomes smaller. Therefore, a percussing sense of striking the cymbal 100 declines.

In contrast, because the first reinforcing part 32 and the second reinforcing part 42 of the cymbal 100 are formed in a belt shape, a weight increase of the entire cymbal 100 can be suppressed. Therefore, a percussing sense of striking the cymbal 100 can be easily prevented from declining. As a result, a player can have a percussing sense similar to that of striking the acoustic cymbal.

A method for manufacturing the cymbal 100 is described herein. First, a dividing step is performed. The acoustic cymbal is cut off along a border region of the bell portion and the bow portion, and is divided into two elements. The element cut off from the region of the bell portion is used as the center part 10, and the element cut off from the bow portion is used as the annular part 20.

In this way, the two elements obtained by dividing the acoustic cymbal are used for the center part 10 and the annular part 20. Hereby, for example, comparing with a case in which the center part 10 and the annular part 20 are formed separately by processing a flat metal plate, a forming operation of the center part 10 and the annular part 20 can be simplified.

Next, a slit forming step is performed. The slit 50 is formed on the annular part 20 obtained by the dividing step.

Next, a second connecting part forming step is performed. The two ends of the annular part 20 formed by the slit forming step are connected by the second connecting part 40. In this second connecting part forming step, the second joint part 41 is adhered to the both ends of the annular part 20 facing each other in the circumference of the annular part 20. Then, the second reinforcing part 42 is adhered to the lower surface of the annular part 20.

At last, a first connecting part forming step is performed. The inner circumference of the annular part 20, which is already attached to the second joint part 42 in the second connecting part forming step, and the outer circumference of the center part 10 are connected by the first connecting part 30. In this first connecting part forming step, the first joint part 31 is adhered to the inner circumference of the annular part 20 and the outer circumference of the center part 10. Then, the first reinforcing part 32 is adhered to the lower surface of the center part 10 and the annular part 20.

A method for adhering the first connecting part 30 and the second connecting part 40 to the center part 10 and the annular part 20 may include, for example, vulcanized adhesion and adhesive, etc.

Figure 3A:
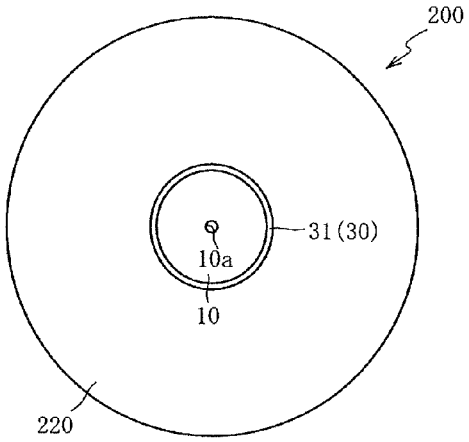
FIG. 3A is a top view of a cymbal according to a second embodiment of the present invention.
Figure 3D:
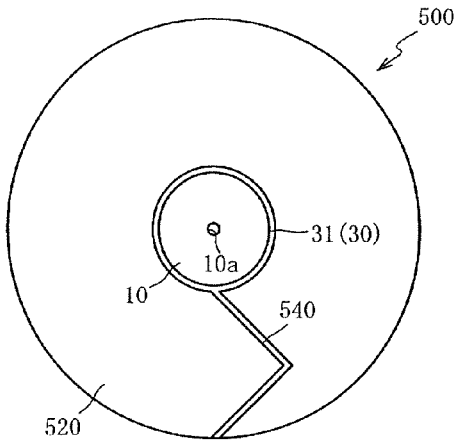
FIG. 3D is a top view of a cymbal according to a fifth embodiment of the present invention.
Figure 3B:
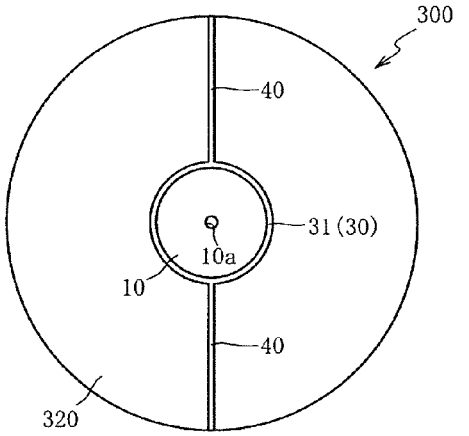
FIG. 3B is a top view of a cymbal according to a third embodiment of the present invention.
Figure 3E:
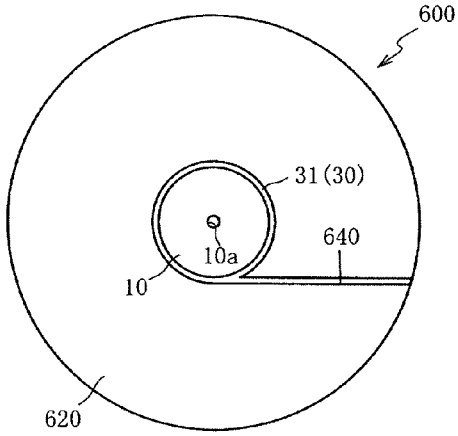
FIG. 3E is a top view of a cymbal according to a sixth embodiment of the present invention.
Figure 3C:
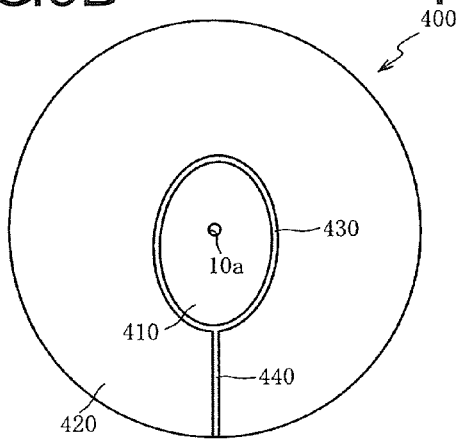
FIG. 3C is a top view of a cymbal according to a fourth embodiment of the present invention.
Figure 3F:
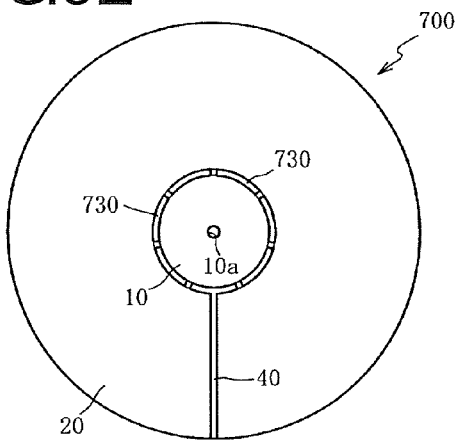
FIG. 3F is a top view of a cymbal according to a seventh embodiment of the present invention.

Next, referring to FIGS. 3A-3F, a second embodiment to a seventh embodiment are described. FIG. 3A is a top view of a cymbal 200 according to the second embodiment. FIG. 3B is a top view of a cymbal 300 according to the third embodiment. FIG. 3C is a top view of a cymbal 400 according to the fourth embodiment. FIG. 3D is a top view of a cymbal 500 according to the fifth embodiment. FIG. 3E is a top view of a cymbal 600 according to the sixth embodiment. FIG. 3F is a top view of a cymbal 700 according to the seventh embodiment. In FIGS. 3A-3F, the cymbals 200, 300, 400, 500, 600 and 700 are schematically illustrated. The same reference numbers, as employed in the first embodiment, will refer to the same parts, and an explanation thereof in detail will be omitted here.

First, referring to FIG. 3A, the second embodiment is described. In the first embodiment, the cymbal 100 includes the second connecting part 40. Meanwhile, in the second embodiment, the second connecting part can be omitted.

As shown in FIG. 3A, the cymbal 200 includes the center part 10, an annular part 220 and the first connecting part 30. The annular part 220 has the same configuration as the annular part 20 except that the slit 50 (see FIG. 2C) is omitted.

In the cymbal 200, a shape of the annular part 220 can be simplified by omitting the second connecting part and the slit. Therefore, the manufacturing cost of the annular part 220 can be reduced.

In addition, since no slit is formed on the annular part 220, a rigidity variation of the annular part 220 in the circumferential direction of the annular part 220 can be prevented. As a result, a variation in the percussing sense obtained according to the position of the annular part 220 can be avoided.

Next, referring to FIG. 3B, the third embodiment is described. In the first embodiment, a case has been described in which the cymbal 100 includes one second connecting part 40. Meanwhile, in the third embodiment, the cymbal 300 includes two second connecting parts 40.

As shown in FIG. 3B, the cymbal 300 includes the center part 10, an annular part 320, the first connecting part 30 and two second connecting parts 40. Those two second connecting parts 40 are arranged at point-symmetric position with respect to the center part 10.

The cymbal 300 includes two second connecting parts 40. Therefore, comparing with a case of including one second connecting part 40, an abutting area of the second connecting parts 40 and the annular part 320 can be largely ensured.

Hereby, vibration of the annular part 320 can be reduced earlier. Therefore, a percussion sound of the annular part 320 can be reduced.

In addition, two second connecting parts 40 are arranged at the point-symmetric position with respect to the center part 10. Therefore, a weight difference between one side and the other side of the annular part 320 with the center part 10 interposed therebetween can be avoided. Accordingly, when securing the cymbal 300 to the rod, the cymbal 300 can be prevented from easily tilting to the one side or the other side of the annular part.

Next, referring to FIG. 3C, the fourth embodiment is described. In the first embodiment, a case has been described in which the center part 10 is formed in a substantially circular shape in top view. Meanwhile, in the fourth embodiment, a center part 410 is formed in a substantially ellipse shape in top view.

As shown in FIG. 3C, the center part 410 is formed in a substantially ellipse shape in top view. In addition, an inner circumference of an annular part 420 is formed in a substantially ellipse shape along an outline of the center part 410. Moreover, the center part 410 and the annular part 420 are connected by a first connecting part 430. As a result, the cymbal 400 is formed in a shape similar to that of the acoustic cymbal.

In other words, the cymbal 400 includes a first part corresponding to the bell portion and a second part corresponding to the bow portion of the acoustic cymbal. In addition, the first connecting part 430 consists of a partial portion, which is formed along a connecting portion of the first part and the second part, and another portion, which is different from the partial portion and exterior to the connecting portion in a radial direction of the connecting part.

Hereby, it can be ensured that the first connecting part 430 in a circumferential direction of the first connecting part 430 is long. Therefore, it can be ensured that a part of the center part 410 and a part of the annular part 420 that are abutted to the first connecting part 430 is broad. Accordingly, vibration of the center part 410 and the annular part 420 can be easily reduced. As a result, percussion sounds of the center part 410 and the annular part 420 can be reduced.

In addition, in the embodiment, a center of the substantially ellipse-shaped center part 410 is formed at a position shifted to one side (lower side in FIG. 3C) of a center of the cymbal 400 (position that the insertion hole 10*a* is formed). Moreover, a second connecting part 440 is formed along a radial direction of the cymbal 400 from a part closest to an outer edge of the annular part 420 (lower side in FIG. 3C).

Hereby, the percentage of the first connecting part 430 and the second connecting part 440 on the other side (upper side in FIG. 3C) is less than that on the one side of the cymbal 400. In other words, the area percentage occupied by the center part 410 and the annular part 420 which include metal, can be increased on the other side of the cymbal 400. Therefore, when playing the cymbal 400, by striking the other side of the cymbal 400, the first connecting part 430 and the second connecting part 440 can be easily prevented from being struck. In addition, the center part 410 and the annular part 420 are formed in a non-point symmetrical shape with respect to the insertion hole 10*a*. Hereby, amplitude of vibration of the center part 410 and the annular part 420 can be reduced in the early stage.

Next, the fifth and the sixth embodiments are described. In the first embodiment, a case has been described in which the second connecting part 40 is formed in a straight line along the radial direction of the annular part 20. Meanwhile, in the fifth embodiment, a second connecting part 540 is formed by bending in a substantially V-shape. In addition, in the sixth embodiment, a second connecting part 640 is formed along a tangential direction of the first connecting part 30.

Hereby, comparing with a case in which the second connecting part is formed along the radial direction of the annular part, the lengths of the second connecting parts 540, 640 can be ensured. In other words, abutting areas of the second connecting parts 540, 640 and the annular parts 520, 620 can be largely ensured. Therefore, vibration of the annular parts 520, 620 can be easily reduced. As a result, percussion sounds of the annular parts 520, 620 can be reduced.

Next, the seventh embodiment is described. In the first embodiment, a case has been described in which the entire outer circumference of the center part 10 and the entire inner circumference of the annular part 20 are connected to the first connecting part 30. Meanwhile, in the seventh embodiment, the outer circumference of the center part 10 and the inner circumference of the annular part 20 are intermittently connected to a first connecting part 730.

In the cymbal 700, the center part 10 and the annular part 20 are intermittently connected to the first connecting part 730. Therefore, the vibration of the center part 10 and the annular part 20 can be reduced and meanwhile the transmission of the vibration which comes from the other one of the center part 10 and the annular part 20 can be suppressed. Accordingly, the amplitude of vibration of the center part 10 and the annular part 20 can be reduced in the early stage. That is, percussion sounds of the center part 10 and the annular part 20 can be reduced.

The present invention was described with respect to the embodiments but the present invention is not limited to the above-mentioned embodiments. It should be apparent to those skilled in the art that various changes and modifications can be made within the spirit and scope of the invention.

For example, a case has been described in which the cymbals 100, 200, 300, 400, 500, 600 and 700 are configured as the percussion instruments for training, but is not necessarily limited thereto. The cymbal 100 may be configured as an electronic percussion instrument (electronic cymbal) having a sensor to detect the vibration of the cymbal 100. In this case, one of the center parts 10, 410 or the annular parts 20, 220, 320, 420, 520, 620 may include the sensor. Besides, both of the center parts 10, 410 and the annular parts 20, 220, 320, 420, 520, 620 may include the sensor.

In the above-mentioned embodiments, a case has been described in which the cymbals 100, 200, 300, 400, 500, 600 and 700 are manufactured by cutting off the acoustic cymbal, but is not necessarily limited thereto. The cymbals 100, 200, 300, 400, 500, 600 and 700 may be manufactured by another method. For example, the center parts 10, 410 or the annular parts 20, 220, 320, 420, 520, 620 may be formed from separate metal materials, then, connected by the first connecting part 30, 430.

In the above-mentioned embodiments, a case has been described in which the upper surfaces of the first joint part 31 and the second joint part 41 are located coplanar with the upper surfaces of the center parts 10, 410 and the annular parts 20, 220, 320, 420, 520, 620, but is not necessarily limited thereto. The upper surfaces of the first joint part 31 and the second joint part 41 may be located lower than the upper surfaces of the center parts 10, 410 and the annular parts 20, 220, 320, 420, 520, 620. Hereby, the first joint part 31 and the second joint part 41 can be prevented from protruding from the upper surfaces of the center parts 10, 410 and the annular parts 20, 220, 320, 420, 520, 620. Therefore, when a player plays the cymbal 100, the first joint part 31 and the second joint part 41 can be easily prevented from being struck.

In the above-mentioned third embodiment, a case has been described in which two second connecting parts 40 are included, but is not necessarily limited thereto. Three or more second connecting parts 40 may be included. Hereby, an abutting area of the second connecting parts 40 and the annular part can be largely ensured so that the amplitude of vibration of the annular part can be reduced in the early stage.

In the above-mentioned fifth embodiment, a case has been described in which the second connecting part 540 is formed by bending in a substantially V-shape, but is not necessarily limited thereto. The second connecting part may be formed by curving, and the second connecting part may be bent or curved at more than two places.

In the above-mentioned embodiments, a case has been described in which the outer circumference of the center parts 10, 410 and the inner circumference of the annular parts 20, 220, 320, 420, 520, 620 are connected by the first joint parts 31, 431, but is not necessarily limited thereto. The outer diameter of the center part may be formed to be larger than the inner diameter of the annular part, and an upper surface or an lower surface of the center part at an outer edge portion of the center part and an upper surface or an lower surface of the annular part at an inner edge portion of the annular part may be connected by the first connecting part. In this case, an abutting area of the first connecting part to the center part and the annular part can be greatly ensured by forming the upper surface and the lower surface thereof in a flat surface. Hereby, the center part and the annular part can be surely connected via the first connecting part.

In the above-mentioned embodiments, a case has been described in which the first connecting parts 30, 430 and the second connecting parts 40, 440, 540, 640 are formed to have a substantially T-shaped cross-section perpendicular to an radial direction of the annular parts 20, 220, 320, 420, 520 and 620, but is not necessarily limited thereto. The first connecting part is formed in a substantially annular shape viewed from an axial direction of the annular part. Moreover, the first connecting part has a fitting concave or concaves disposed at one of or both of an inner circumference and an outer circumference of the first connecting part. Hereby, the shape of the cross-section (which is perpendicular to the radial direction) of the first connecting part is formed in a substantially U-shape or in a substantially H-shape. In this case, the outer circumference of the center parts 10, 410 or the inner circumference of the annular parts 20, 220, 320, 420, 520, 620 are fit into the fitting concave or concaves of the first connecting part. Hereby, the center parts 10, 410 and the annular parts 20, 220, 320, 420, 520, 620 can be surely connected via the first connecting part.

Each of the components described in each of the embodiments can be replaced to each of the components described in the other embodiment, or each of the components described in the other embodiment can be combined or added to each of the components described in each of the embodiments. For example, the shape of two first connecting parts 340 described in the third embodiment can be replaced to the second connecting part 640 in the sixth embodiment.

The invention claimed is:

1. A cymbal, comprising:

an annular part having an annular shape having a first predetermined rigidity, a center part located at an inner circumference of the annular part and having a second predetermined rigidity, and a first connecting part including a first elastic material and connecting an outer circumference of the center part and the inner circumference of the annular part, wherein, the center part is formed in a cup shape sloping downward toward the outer circumference of the center part in a radial direction of the center part; and the annular part is formed in an annular shape sloping downward toward an outer circumference of the annular part at an angle less steep than that of the center part in a radial direction of the annular part.

2. The cymbal as claimed in claim 1, comprising:

at least one slit extended from the inner circumference of the annular part to an outer circumference of the annular part and dividing the annular part to form two ends of the annular part, and a second connecting part including a second elastic material and connecting the two ends of the annular part facing each other with the at least one slit therebetween.

3. The cymbal as claimed in claim 2, wherein the at least one slit is formed along a radial direction of the annular part.

4. The cymbal as claimed in claim 2, wherein the at least one slit is a plurality of the slit.

5. The cymbal as claimed in claim 2, wherein the second connecting part is bent or curved.

6. The cymbal as claimed in claim 2, wherein the at least one slit is formed along a tangential direction of the first connecting part.

7. The cymbal as claimed in claim 2, wherein the first connecting part comprises:

a joint part for connecting the inner circumference of the annular part and the outer circumference of the center part, and a reinforcing part having a belt shape formed along the joint part and crossing over a lower surface of the annular part and a lower surface of the center part.

8. The cymbal as claimed in claim 2, wherein the annular part and the center part are formed in a non-point symmetrical shape with respect to a center of the cymbal.

9. The cymbal as claimed in claim 2, wherein the outer circumference of the center part and the inner circumference of the annular part are intermittently connected by the first connecting part.

10. The cymbal as claimed in claim 2, wherein the center part is formed in a cup shape sloping downward toward the outer circumference of the center part in a radial direction of the center part; and the annular part is formed in an annular shape sloping downward toward the outer circumference of the annular part at an angle less steep than that of the center part in a radial direction of the annular part.

11. The cymbal as claimed in claim 2, comprising:

a sensor for detecting a vibration produced by striking the annular part or the center part.

12. The cymbal as claimed in claim 1, wherein the first connecting part comprises:

a joint part for connecting the inner circumference of the annular part and the outer circumference of the center part, and a reinforcing part having a belt shape formed along the joint part and crossing over a lower surface of the annular part and a lower surface of the center part.

13. The cymbal as claimed in claim 1, wherein the annular part and the center part are formed in a non-point symmetrical shape with respect to a center of the cymbal.

14. The cymbal as claimed in claim 1, wherein the outer circumference of the center part and the inner circumference of the annular part are intermittently connected by the first connecting part.

15. The cymbal as claimed in claim 1, comprising:

a sensor for detecting a vibration produced by striking the annular part or the center part.

16. A method for manufacturing a cymbal, comprising:

dividing an acoustic cymbal into an annular part having an annular shape and a center part located at an inner circumference of the annular part, and connecting the inner circumference of the annular part and an outer circumference of the center part by a first connecting part including an elastic material, wherein, the center part is formed in a cup shape sloping downward toward the outer circumference of the center part in a radial direction of the center part; and the annular part is formed in an annular shape sloping downward toward an outer circumference of the annular part at an angle less steep than that of the center part in a radial direction of the annular part.

17. The method for manufacturing the cymbal as claimed in claim 16, comprising:

forming a slit extended from the inner circumference of the annular part to an outer circumference of the annular part and dividing the annular part to form two ends of the annular part facing each other, and connecting the two ends of the annular part facing each other with the slit therebetween by a second connecting part that includes an elastic material.

* * * * *